US008794823B2

(12) United States Patent
Vardi

(10) Patent No.: US 8,794,823 B2
(45) Date of Patent: Aug. 5, 2014

(54) MAGNETIC RESONATOR FOR A MECHANICAL TIMEPIECE

(71) Applicant: Ilan Vardi, Neuchatel (CH)

(72) Inventor: Ilan Vardi, Neuchatel (CH)

(73) Assignee: Asgalium Unitec SA, Neuchatel (CH)

( * ) Notice: Subject to any disclaimer, the term of this patent is extended or adjusted under 35 U.S.C. 154(b) by 0 days.

(21) Appl. No.: 13/917,430

(22) Filed: Jun. 13, 2013

(65) Prior Publication Data

US 2013/0279302 A1 Oct. 24, 2013

Related U.S. Application Data

(63) Continuation of application No. PCT/EP2011/072941, filed on Dec. 15, 2011.

(30) Foreign Application Priority Data

Dec. 15, 2010 (EP) ..... 10195101

(51) Int. Cl.
*G04B 15/00* (2006.01)
*G04C 5/00* (2006.01)

(52) U.S. Cl.
CPC ..... *G04C 5/005* (2013.01)
USPC ..... 368/126; 368/167; 74/1.5; 310/25

(58) Field of Classification Search
CPC ..... G04C 5/005
USPC ..... 368/124, 126, 167, 168
See application file for complete search history.

(56) References Cited

U.S. PATENT DOCUMENTS 1,600,088 A * 9/1926 Burstyn ..... 74/144
2,373,429 A 4/1945 Straumann (Continued)

FOREIGN PATENT DOCUMENTS

CH 594201 2/1977
FR 1351427 2/1964

(Continued)

OTHER PUBLICATIONS

International Preliminary Report on Patentability (English translation) dated Jun. 27, 2013, for corresponding PCT Application No. PCT/EP2011/072941 (10 pages).

(Continued)

*Primary Examiner* — Vit W Miska
(74) *Attorney, Agent, or Firm* — Finnegan, Henderson, Farabow, Garrett & Dunner, LLP

(57) ABSTRACT

A magnetic resonator, for a timepiece, is disclosed which comprises an oscillator of the tuning-fork type having first and second branches in the form of a U of which at least a first branch supports a first permanent magnet defining a first magnetic field, an escape wheel, designed to be arranged in engagement with a watchwork gear train in order to allow it to be driven by a power source of the timepiece and, situated within range of said first permanent magnet in order to undergo the influence of the first magnetic field. In particular, provision is made for the escape wheel to be free and support at least two permanent magnets, preferably at least four, arranged so that the vibrations of the first branch of the tuning fork, on the one hand, control the rotation speed of the escape wheel and, on the other hand, are sustained periodically by the magnetic interaction between the first permanent magnet of the tuning fork and the permanent magnets of the escape wheel in order to define a free escapement.

20 Claims, 8 Drawing Sheets

(56) References Cited

U.S. PATENT DOCUMENTS

| | | | | | |
|---|---|---|---|---|---|
| 2,571,085 | A | | 8/1951 | Clifford | |
| 2,743,614 | A | * | 5/1956 | Clifford | 74/1.5 |
| 2,971,323 | A | | 2/1961 | Hetzel | |
| 3,132,522 | A | | 5/1964 | Goldfarb | |
| 3,208,287 | A | | 9/1965 | Ishikawa et al. | |
| 3,410,083 | A | | 11/1968 | Korr | |
| 3,451,280 | A | * | 6/1969 | Hetzel | 74/142 |
| 3,465,511 | A | * | 9/1969 | Serge | 368/158 |
| 3,540,206 | A | * | 11/1970 | Hetzel | 368/128 |
| 3,566,167 | A | * | 2/1971 | Gaston | 310/21 |
| 3,581,128 | A | * | 5/1971 | Meisner et al. | 310/21 |
| 3,599,501 | A | * | 8/1971 | Hetzel | 74/142 |
| 3,727,396 | A | * | 4/1973 | Hetzel | 368/167 |
| 3,775,963 | A | * | 12/1973 | Clapham | 368/85 |
| 3,917,965 | A | * | 11/1975 | Raval | 310/21 |

FOREIGN PATENT DOCUMENTS

| | | |
|---|---|---|
| GB | 660581 | 11/1951 |
| GB | 838430 | 6/1960 |

OTHER PUBLICATIONS

International Search Report for International Application No. PCT/EP2011/072941, dated Feb. 27, 2012 (8 pages).

Written Opinion for International Application No. PCT/EP2011/072941, dated Dec. 15, 2011 (7 pages).

* cited by examiner

MAGNETIC RESONATOR FOR A MECHANICAL TIMEPIECE

This application is a continuation application of prior International Application No. PCT/EP2011/072941, filed on Dec. 15, 2011 and claiming priority to European (EP) Patent Application No. 10195101.0, filed Dec. 15, 2010. The disclosures of the above-referenced applications are expressly incorporated herein by reference to their entireties.

TECHNICAL FIELD

The present invention relates to a magnetic resonator for a mechanical timepiece, in particular for a wristwatch.

More precisely, and without limitation, the invention relates to such a magnetic resonator that may comprise an oscillator of the tuning-fork type having first and second branches arranged substantially in the form of a U, at least one of the branches supporting at least one first permanent magnet defining a first magnetic field, and an escape wheel, designed to be arranged in engagement with a first mobile of a watchwork gear train in order to allow it to be driven by a power source of the timepiece and situated within range of the first permanent magnet in order to undergo the influence of the first magnetic field.

The high quality factor of an oscillator such as a tuning fork, namely approximately ten to fifty times that of a conventional sprung balance, makes it attractive in the context of a clockwork application.

Moreover, the present invention also relates to a clockwork movement furnished with such a resonator and a timepiece, in particular but not exclusively of the wristwatch type, furnished with such a clockwork movement.

"Permanent magnet" should be understood in this instance, without departing from the context of the invention, to be an element producing a permanent magnetic field, irrespective of what its shape may be, that is to say that it could consist of a portion of material held in a solid block and having sustained a treatment for the purpose of having the required magnetic properties, of a fitted part, or even of a deposited layer, of a suitable magnetic material.

BACKGROUND

Many clockwork devices comprising a tuning fork as an oscillator have already been disclosed in the prior art.

As an example, Max Hetzel is at the origin of a large number of patented inventions relating to the use of a tuning fork as an oscillator, which have led to the production of the Accutron (registered trade mark) wristwatch marketed by Bulova Swiss SA.

The Accutron watch however comprises an electronic resonator since each branch of the corresponding tuning fork supports a permanent magnet associated with an electromagnet fixedly mounted on the frame of the watch. The operation of each electromagnet is slaved to the vibrations of the tuning fork by means of the magnets that it supports, such that the vibrations of the tuning fork are sustained by the transmission of periodic magnetic pulses of the electromagnets to the permanent magnets. One of the branches of the tuning fork actuates a ratchet making it possible to rotate the mobiles of the watchwork gear train of the watch.

U.S. Pat. No. 2,971,323, for example, originating from a filing dating from 1957, describes such a mechanism which cannot however be suitable for the production of a purely mechanical watch, that is to say having no electronic circuits. Specifically, a real need exists, in market terms, for purely mechanical timepieces having a working accuracy that is enhanced relative to the known pieces.

It should be noted that the Accutron piece is still currently marketed by Bulova Swiss SA.

Patent CH 594201, originating from a filing dating from 1972, describes a double-oscillator resonator system. Use is made of the frequency stability of the oscillations of a tuning fork by magnetic interaction in order to stabilize the oscillations of a balance wheel of conventional shape, hence having a lesser quality factor than that of the tuning fork. For this purpose, the branches of the tuning fork, on the one hand, and the balance wheel, on the other hand, support permanent magnets arranged so as to interact with one another. The corresponding interaction makes it possible both to sustain the oscillations of the tuning fork and to stabilize the frequency of oscillations of the balance wheel.

However, although this does not appear explicitly in this patent, it is evident that this mechanism is necessarily coupled to a mechanical escapement in order to convert the periodic oscillations of the balance wheel into a one-way movement making it possible to drive the mobiles of a watchwork gear train. Thus, it is likely that the balance wheel is coupled to a conventional mechanical escapement arranged to sustain the oscillations. Consequently, the mechanism described in this document makes it possible to enhance the frequency stability of the oscillations of a balance wheel, but this is done at the price of a markedly increased complexity and space requirement relative to a conventional mechanism with a single oscillator. Moreover, the high quality factor of the tuning fork is only partially used in the proposed solution since, in the end, it is the balance wheel which controls the movements of the watchwork gear train in a manner similar to what is used in the conventional systems.

Alternative solutions, more suited to the spatial constraints specific to the construction of a wristwatch, have also been divulged. Specifically, patent U.S. Pat. No. 3,208,287, originating from a filing dating from 1962, describes a resonator comprising a tuning fork coupled to an escape wheel via magnetic interactions. More precisely, the tuning fork supports permanent magnets interacting with the escape wheel, the latter being made of a magnetically conductive material. The escape wheel is linked kinematically to a power source which may be mechanical or take the form of a motor, while it comprises apertures, in its thickness, such that it forms a variable reluctance magnetic circuit when it is rotated, in relation with the magnets supported by the tuning fork.

Consequently, a permanent interaction of substantial intensity takes place between the tuning fork and the escape wheel, which may be qualified as magnetic locking, such a construction therefore consisting of an escapement that is not free. The provision of power from the escape wheel to the tuning fork in order to sustain the oscillations thereof, even though it is weak, is carried out continuously and constitutes a significant source of disruption from the point of view of the isochronism of these oscillations. Similarly, the guidance of the escape wheel by the tuning fork is carried out continuously.

Thus, the type of interaction used in this construction is similar to a contact which is unfavorable from the point of view of working accuracy.

It will be noted that there is a large number of patents to cover technical solutions based on the reluctance principle. It is notably possible to cite the patents GB 660,581, the filing of which dates back to 1948, the patent GB 838,430, of which the filing dates back to 1955, or even the patent U.S. Pat. No. 2,571,085 of which the filing dates back to 1949.

SUMMARY

One object of the present invention is to alleviate the drawbacks of tuning-fork resonators known in the prior art, by proposing a resonator for a mechanical timepiece, in particular for a wristwatch, having a high quality factor and a high isochronism. Other objects and advantages of the present invention are disclosed herein.

In accordance with certain embodiments, the present invention relates to a resonator of the type mentioned above, wherein the escape wheel is free and may support at least two permanent magnets, preferably at least four, arranged so that the vibrations of the branch of the tuning fork, on the one hand, control the rotation speed of the escape wheel and, on the other hand, are sustained periodically by the magnetic interaction between the first permanent magnet of the tuning fork and the permanent magnets of the escape wheel in order to define a free escapement.

By virtue of the above features, the resonator according to embodiments of the present invention may provide the full benefits of the high quality factor of the tuning fork, that is to say without the nature of the escapement collaborating with it attenuating these benefits, as is the case with the known mechanisms of the prior art.

Indeed, the nature of the interaction used between the tuning fork and the escape wheel, and the possibility of adjusting the magnetic properties of the permanent magnets used according to the requirements, make it possible to optimize the operation of the resonator according to the invention, notably so that the branches of the tuning fork exert a control of the rotation speed of the escape wheel, by their vibrations, while retrieving from the latter the quantity of power that is sufficient to maintain their vibrations with an excellent isochronism.

This magnetic interaction, between the permanent magnets positioned on the escape wheel and the permanent magnet placed on one of the branches of the tuning fork, is of very low amplitude and has a very brief duration. It intervenes only when one of the permanent magnets of the escape wheel is placed opposite the magnet of the tuning fork. The interaction is of a magnetic nature only, a space remaining between the two permanent magnets placed face to face. The arrangement of the magnets of the escape wheel associated with the magnet or with the magnets positioned on the branches makes it possible to sustain the free oscillations of the branches of the tuning fork. These free oscillations are natural normal oscillations. One advantage of this type of resonator with respect to the prior art is the reduction in disruptions of the oscillations. The weak interaction of the magnets specifically makes it possible to produce a free escapement.

It will be noted that these resonators have known no major innovation for virtually about forty years, which could lead to the belief that everything had been invented in this field. Thus, the merit of the Applicant lies in having designed the resonator according to the present invention, contrary to all expectations, in which the amplitude of the magnetic interaction intervening between the tuning fork and the escape wheel is substantially greater than that intervening in the mechanisms based on the reluctance principle, which a priori appears to be unfavorable from the point of view of isochronism, this increase in amplitude being compensated for by the use of a shorter time of the interaction in question, namely of a free escapement as opposed to the known mechanisms, leading overall to a more favorable result.

Moreover, the mechanical resonator with magnetic escapement according to the present invention has a construction and an assembly that are simpler than the conventional free escapements such as the Swiss anchor escapements or detent escapements. The conventional mechanical free escapements are notably more complex in the adjustment of the relative positions of their component parts.

Moreover, the resonator according to the present invention has neither a ratchet system nor a mechanical contact system. The durability of such a resonator is consequently greater than that of the conventional mechanical resonators.

Preferably, the escape wheel may support 2n permanent magnets, n being at least equal to 1, preferably less than or equal to forty. These magnets may advantageously be distributed evenly close to the periphery or at the periphery of the escape wheel, in order to ensure a regular rotation of the latter.

According to a preferred embodiment, two adjacent magnets of the escape wheel may be arranged relative to one another in order to present to the magnet of the tuning fork, or to each magnet of the tuning fork, respective inverted polarities, when the escape wheel rotates on itself.

By virtue of these features, the respective movements of the branch of the tuning fork and of the escape wheel may be synchronized such that, when the branch of the tuning fork moves away from the escape wheel, the latter has a magnet giving rise to a repulsion relative to the magnet of the branch, while, when the branch comes closer to the escape wheel, the latter has a magnet giving rise to an attraction in relation to the magnet of the branch.

Advantageously, the escape wheel may be arranged between the branches of the tuning fork, the second branch then preferably being furnished with a second permanent magnet defining a second magnetic field. In this case, the magnets of the tuning fork may preferably be diametrically opposed with reference to the escape wheel. Moreover, the magnets of the escape wheel may advantageously be arranged, in this case, such that they are diametrically opposed in twos by presenting magnetic orientations such that they have interactions of the same nature with the magnets of the tuning fork.

Such an arrangement relative to the magnets makes it possible to ensure that the tuning fork oscillates according to its first vibration mode, namely that its two branches move away from one another and move closer to one another simultaneously.

Moreover, the present invention also relates to a clockwork movement, for a mechanical timepiece, comprising a resonator reflecting the features above and a timepiece furnished with such a clockwork movement.

According to a variant embodiment, the escape wheel may be situated outside the branches of the tuning fork.

In all cases, it can be envisaged to provide several escape wheels with identical or different oscillation frequencies, likewise with their respective diameters and/or their respective rotation speeds, in order to satisfy different requirements.

According to a variant embodiment as an illustration, it is possible to provide that the mechanism according to the invention comprises a first escape wheel, associated with a first branch of the tuning fork in order to rotate with a first rotation speed, and a second escape wheel, associated with another branch of the tuning fork, in order to rotate with a second rotation speed. In this case, one of the escape wheels may be associated with members for displaying the current time, while the other may be associated with members for displaying short times, notably by means of a function of the chronograph type.

BRIEF DESCRIPTION OF THE DRAWINGS

Other features and advantages of the present invention will appear more clearly on reading the detailed description of a preferred embodiment below, made with reference to the appended drawings given as non-limiting examples and in which.

DETAILED DESCRIPTION OF THE EMBODIMENTS

Figure 1:
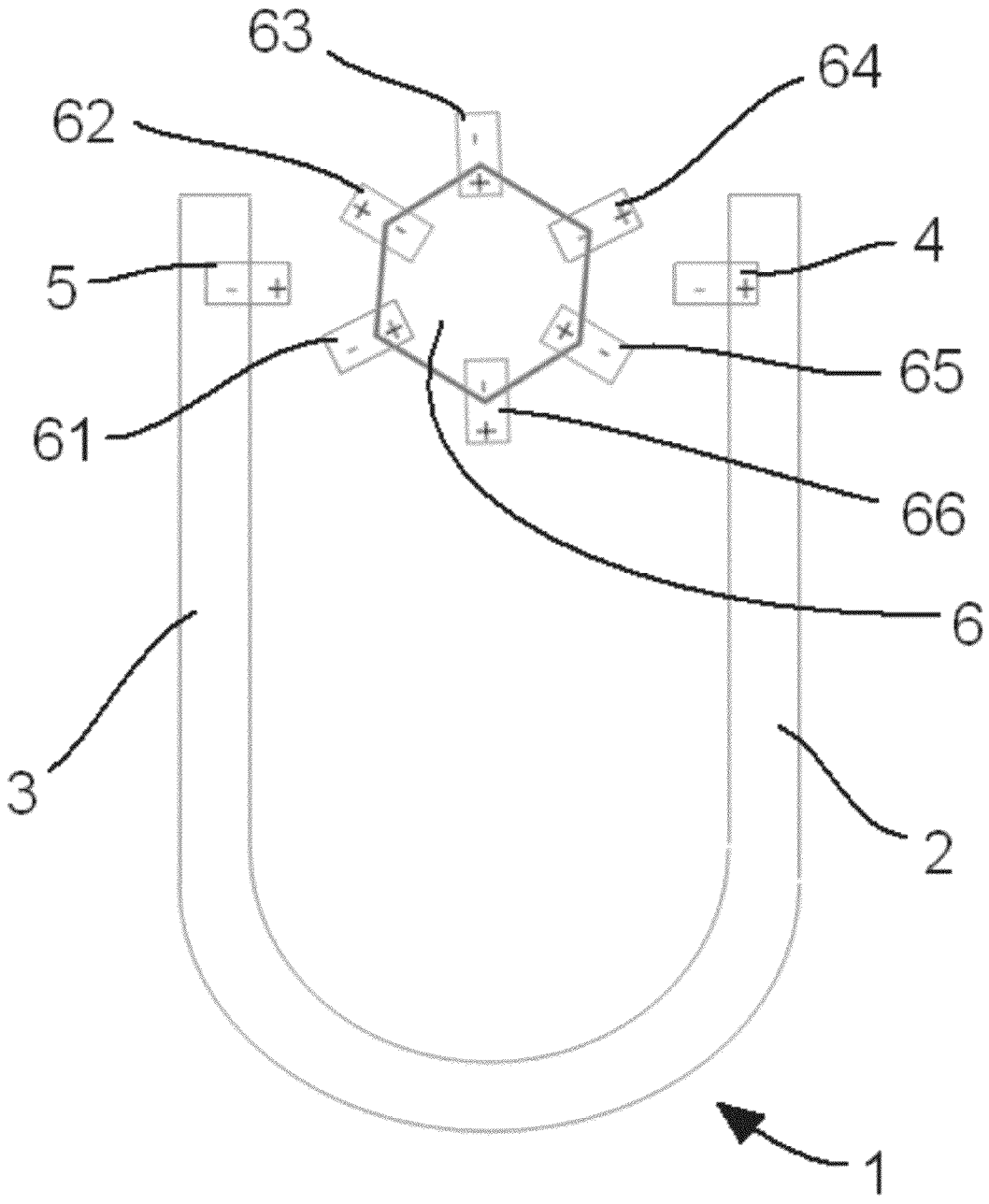
FIG. 1 represents a simplified front view of a mechanical resonator with magnetic escapement, in a first configuration, comprising an escape wheel placed between the branches of a U-shaped tuning fork.
Figure 2:
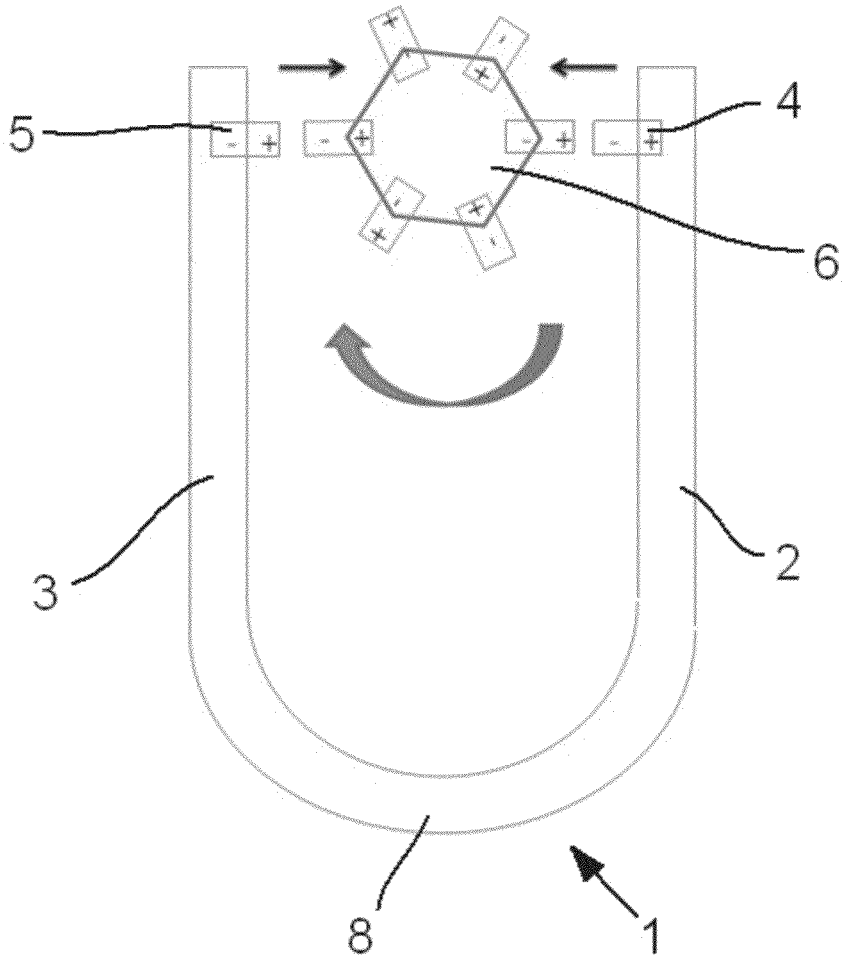
FIG. 2 represents a simplified front view of the resonator of FIG. 1 in a second configuration.
Figure 3:
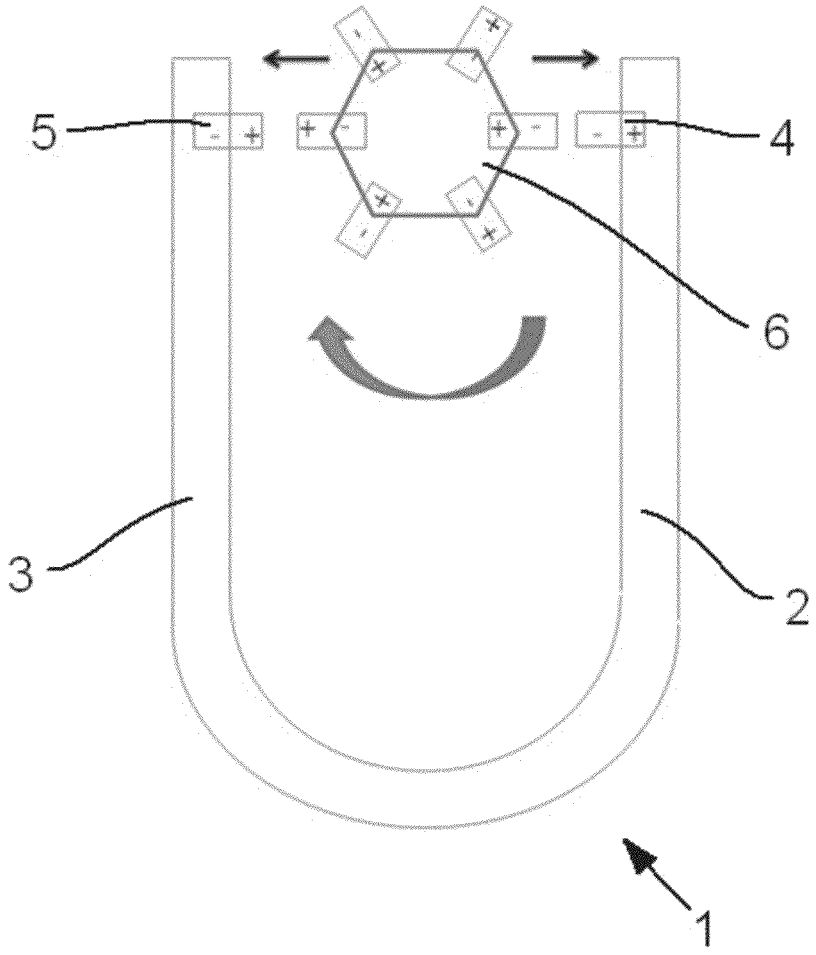
FIG. 3 represents a simplified front view of the resonator of FIG. 1 in a third configuration.

FIGS. 1 to 3 illustrate in a schematic and simplified manner the operation of a mechanical tuning-fork resonator according to a preferred embodiment of the present invention, in first, second and third configurations respectively.

The resonator comprises a U-shaped tuning fork 1 having a pair of branches 2, 3 each of which supports a permanent magnet 4, 5 close to its free end defining first and second magnetic fields.

Each magnet is placed on its branch having its poles arranged in a direction substantially perpendicular to the longitudinal direction of the branch. Moreover, the magnets 4 and 5 are substantially aligned and oriented here in the same manner, that is to say mutually presenting opposite poles.

An escape wheel 6 is schematically illustrated in FIGS. 1 to 3, the latter being placed between the two branches 2 and 3 of the tuning fork 1.

The escape wheel 6 in this instance supports six permanent magnets 61 to 66 evenly arranged at its periphery while having their poles substantially aligned in radial directions. Two adjacent magnets of the escape wheel have opposite orientations, from the point of view of the magnetic field produced, with reference to the center of the escape wheel. In other words, two adjacent permanent magnets of the escape wheel are arranged relative to one another in order to present to a given magnet of the tuning fork, when the escape wheel turns, polarities that are respectively inverted when they are situated facing the latter.

Advantageously, the escape wheel 6 is kinematically connected to a power source (not illustrated) by means of a conventional watchwork gear train with a predefined gearing ratio and, the implementation of which will pose no particular difficulty to those skilled in the art. In particular, the escape wheel preferably supports an escapement pinion arranged in engagement with a first mobile of the watchwork gear train. By this kinematic connection, the escape wheel sustains a permanent force tending to make it turn in a predefined rotation direction (in the clockwise direction in FIGS. 2 and 3).

The escape wheel 6 and its magnets 61 to 66 have dimensions such that the latter are situated within range of the magnets 4, 5 of the tuning fork, so that their magnetic fields can interact with one another.

It will be noted, as an example, that for a tuning fork of 25 mm length vibrating at 360 Hz, the amplitude of the vibrations of its branches is of the order of 5 hundredths of a millimeter.

Because of the relative configurations of the magnets of the escape wheel, each of the magnets of the tuning fork sustains alternately attractions and repulsions with reference to the escape wheel.

Specifically, the escape wheel 6 is free to rotate on itself, in the clockwise rotation direction, as a consequence of the permanent force that it sustains from the power source of the corresponding timepiece.

This being so, starting from the configuration of FIG. 1 in which the interactions between its magnets and those of the tuning fork are virtually zero, it rotates to the configuration illustrated in FIG. 2.

The tuning fork may advantageously be secured to the frame of a clockwork movement in a conventional manner, that is to say via an arm secured to the frame via a first end and, to a point situated in the middle of the base 8 of the tuning fork via its other end. In this situation, it is preferable for the tuning fork to vibrate according to its first vibratory mode, that is to say with its branches having exactly opposite movements. In other words, the two branches 2 and 3 move apart and toward each other simultaneously.

Thus, the configuration illustrated in FIG. 2 corresponds, initially, to a mutual closing of the two branches 2 and 3. Given the relative orientations and positions of the magnets 4, 5 and 61 to 66, the branches 2 and 3 of the tuning fork sustain an attraction toward the escape wheel 6 defining a transfer of energy from the escape wheel to the tuning fork for the purpose of sustaining the vibrations of the latter.

At the same time, the tuning fork acts as a magnetic brake on the escape wheel by slowing its rotation induced by the force exerted by the power source of the clockwork movement.

Since the amplitude of the force originating from the magnetic interaction between the tuning fork and the escape wheel is very small with reference to the oscillations of the tuning fork, the latter follow one another naturally and the branches 2, 3, after having achieved a maximum relative closing, deform in the opposite direction in order to move away from one another.

The escape wheel 6 continues its rotary movement at the same time, which brings it to its position of FIG. 3, while the branches 2, 3 are still in their relative separating phase.

In the configuration of FIG. 3, the magnets situated opposite one another present opposite polarities to one another, which results in the generation of a repulsion force between the branches 2, 3 of the tuning fork and the escape wheel. This repulsion defines a new transfer of energy from the escape wheel to the tuning fork, for the purpose of sustaining the vibrations of the latter.

It is found from the foregoing that an escape wheel supporting six permanent magnets carries out a complete rotation on itself in six steps corresponding to three complete oscillations of the tuning fork, therefore the frequency of rotation of the escape wheel is in this instance equal to a third of that of the tuning fork.

In general, the escape wheel advances by two steps during each complete oscillation of the tuning fork. In other words, the frequency of the steps of the escape wheel is double that of the frequency of vibration of the tuning fork, while its frequency of rotation is f/n Hz when it supports 2n permanent magnets, f being the frequency of vibration of the tuning fork.

The result of this is that the speed of rotation of the escape wheel and the gearing ratios of the watchwork and display gear trains can be adjusted according to the requirements, irrespective of the frequency of oscillation of the tuning fork, notably by modifying the number of permanent magnets supported by the escape wheel.

Naturally, the frequency of vibration of the tuning fork can be adjusted according to requirements, in conventional manner, notably by changing the distribution of the weights in its branches or its material.

Advantageously, for a clockwork application, it is possible to provide for the frequency of vibration of the tuning fork in the resonator according to the invention to be substantially between 2 and 1000 Hz.

A frequency of vibration greater than the frequencies of oscillation of the conventional sprung balances may, for example, be used in applications such as the measurements of short times. As an example, for carrying out a chronograph function allowing measurement in hundredths of seconds, the escape wheel must advance by one step at least every hundredth of a second. It must therefore have a step frequency of 100 Hz (or a multiple of 100 Hz), which corresponds to a frequency of vibration of the tuning fork of 50 Hz (or a multiple of 50 Hz). Such operating frequencies cannot be envisaged today in wristwatches using an oscillator of the sprung balance type except for short and clearly determined durations. It should be noted that the production of a mechanical escapement operating at such frequencies is also not without its problems, notably in terms of wear. Since the escape wheel is the terminal portion of a mechanical gear train, it is preferable that it operates with a low rotation frequency for the same reasons of wear and mechanical simplicity. This is possible by providing an appropriate number of magnets. As an example, if twelve magnets are provided on the escape wheel, with a tuning fork vibrating at 50 Hz, the escape wheel rotates with a frequency of rotation of 8.33 Hz, similar to what it has in the known clockwork movements, while allowing the measurement of hundredths of a second.

Preferably, the escape wheel supports 2n permanent magnets, n being at least equal to 1, preferably less than or equal to forty. These magnets are advantageously distributed evenly close to the periphery or at the periphery of the escape wheel, in order to ensure a regular rotation of the latter. Naturally, the diameter of the escape wheel can influence the number of magnets that it comprises. Too large a number of magnets is undesirable because it would tend to give rise to a virtually continuous interaction between the escape wheel and the tuning fork, detrimental to the isochronism of the resonator according to the invention.

Naturally, the escape wheel 6 can be arranged outside the tuning fork in order to interact with a single branch of the tuning fork without departing from the context of the present invention.

Figure 4:
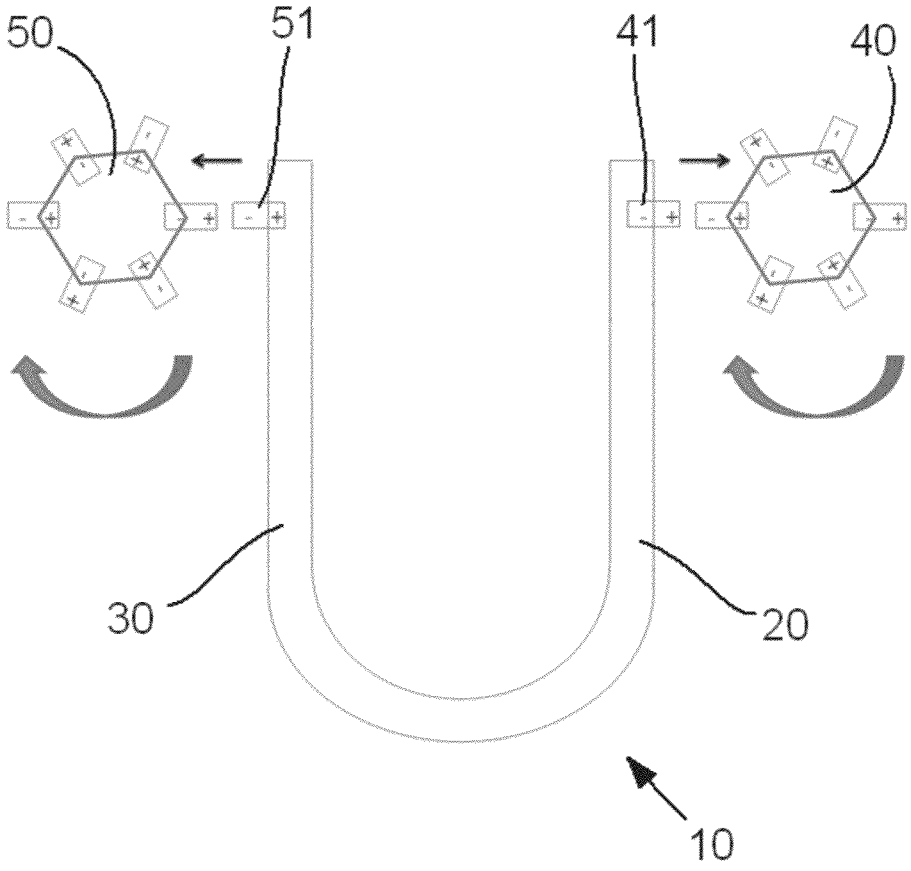
FIG. 4 represents a simplified front view of a resonator according to a variant embodiment in which it comprises two escape wheels positioned outside the branches of the tuning fork in a first configuration.
Figure 5:
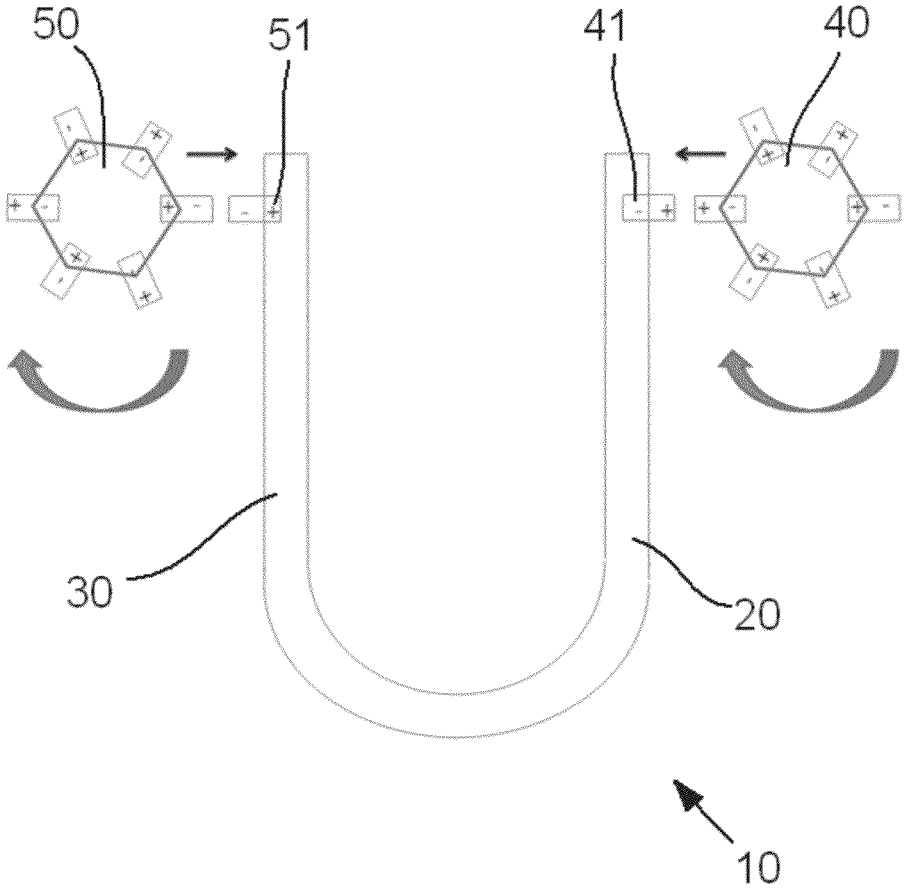
FIG. 5 represents a simplified front view of the resonator of FIG. 4, in a second configuration.

An additional example of application that is of particular value is shown in FIGS. 4 and 5.

According to this variant embodiment, two escape wheels 40 and 50 are respectively associated with the first and second branches 20, 30 of a tuning fork 10, making it possible to control two distinct display gear trains (not shown).

For reasons of simplification of the illustration, the two escape wheels illustrated in FIGS. 4 and 5 are identical. They may be used to control the respective displays of two rolling trains for example one displaying the solar time and the other the sidereal time.

The operating principle of the resonator illustrated in FIGS. 4 and 5 will not be explained in detail to the extent that it is similar to that of the embodiment of the preceding figures. The main difference relative to the preceding embodiment lies in the fact that pulses are transmitted independently to each of the branches of the tuning fork by the escape wheel that is associated therewith, their respective magnets 41, 51 advantageously being arranged toward the outside, facing the escape wheels.

In this case, it is also possible to provide, as an alternative, for the escape wheels 40 and 50 to be different from one another, notably for them to support different numbers of permanent magnets, without departing from the context of the present invention. Similarly, the gear ratios of the display gear trains respectively associated with one and with the other of the escape wheels may be different such that, for example, one is associated with the display of the current time, while the other is associated with a chronograph function.

Figure 6:
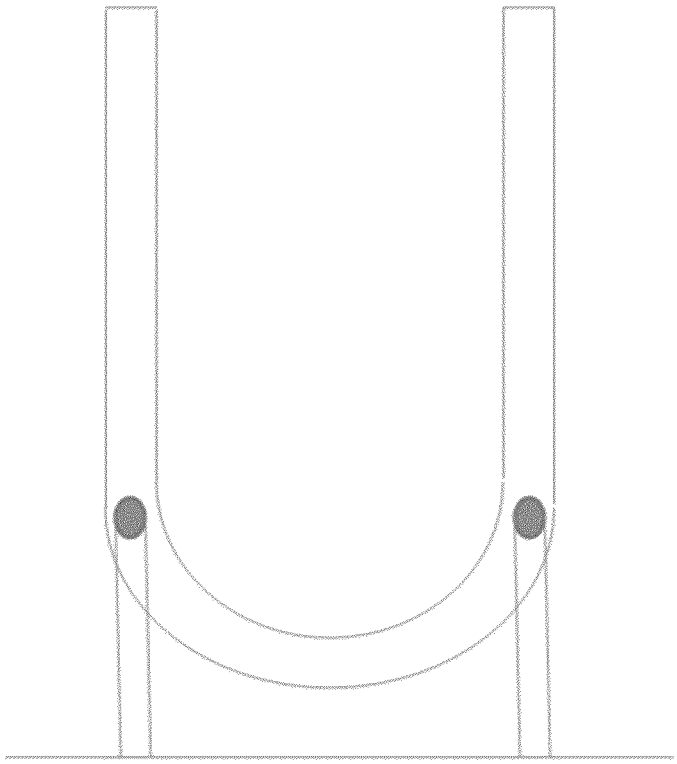
FIG. 6 represents a simplified front view illustrating an alternate method of attaching the tuning fork to the frame of a clockwork movement.

Furthermore, FIG. 6 illustrates a variant of attachment of the tuning fork to the frame of a clockwork movement. Instead of attaching the tuning fork via a single arm, secured to the mid-point of its base as mentioned above, it is possible to attach it by means of two arms connected to the tuning fork by its two primary nodes, in a known manner, without departing from the context of the invention. Similarly, it can also be envisaged to place the magnets at the secondary nodes.

Figure 7A:
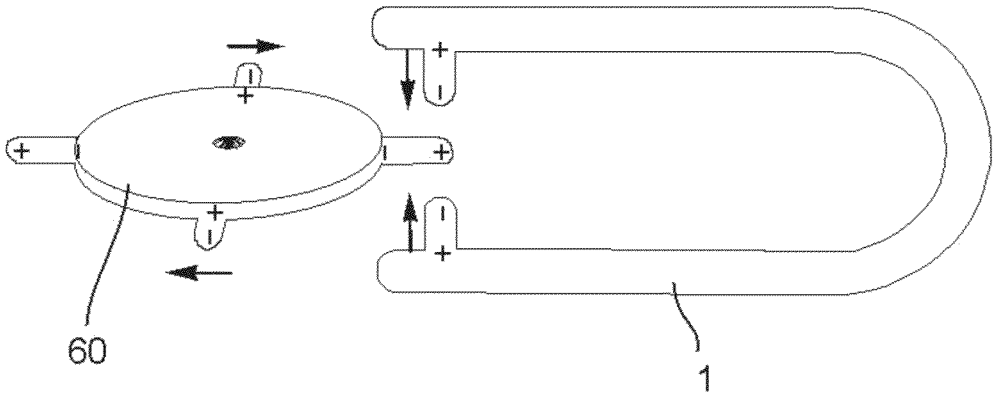
FIGS. 7*a* and 7*b* represent a simplified view in perspective of a resonator according to a second variant embodiment.
Figure 7B:
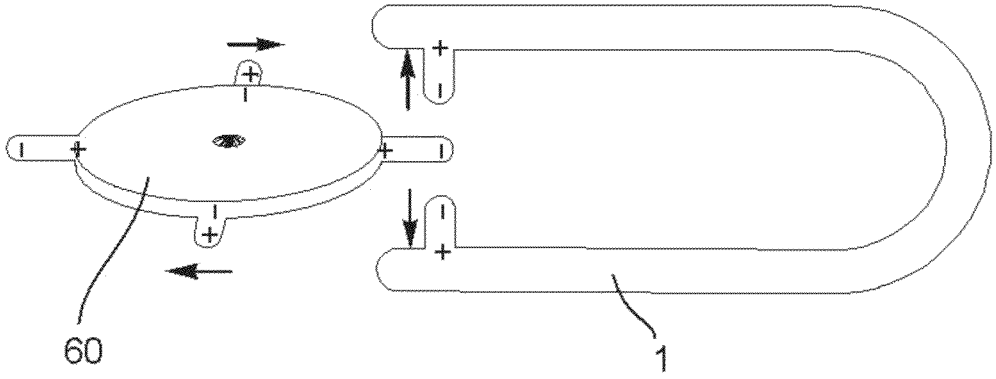

FIGS. 7*a* and 7*b* represent a resonator according to a second variant embodiment of the present invention.

In this variant, the tuning fork 1 and the escape wheel 60 are contained in respective planes that are substantially orthogonal to one another.

The one skilled in the art will be able to chose to place any one of these two members in a plane parallel to the general plane of the corresponding clockwork movement, the other member then being orthogonal to it, depending on requirements. To the extent that the escape wheel forms part of the mechanical gear train, it is preferable for it to be arranged in the same plane as the clockwork movement, which means that the tuning fork is substantially orthogonal to the general plane of the clockwork movement and of the watch. Such a configuration of the tuning fork has, a priori, never been the subject of a product sold on the market hitherto.

The operating principle of the resonator according to this variant embodiment is similar to what has been described above and will therefore not be repeated in detail.

FIG. 7*a* illustrates a position of the escape wheel 60 in which one of its magnets interacts with the magnets of the tuning fork in order to give rise to a mutual attraction.

FIG. 7*b* illustrates a position of the escape wheel 60 in which another of its magnets interacts with the magnets of the tuning fork in order to give rise to a mutual repulsion.

Figure 8A:
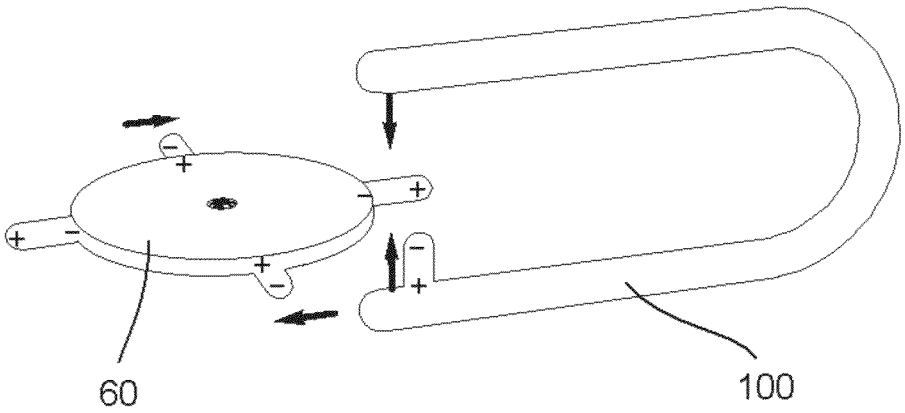
FIGS. 8*a* and 8*b* represent a simplified view in perspective of a resonator according to a third variant embodiment.
Figure 8B:
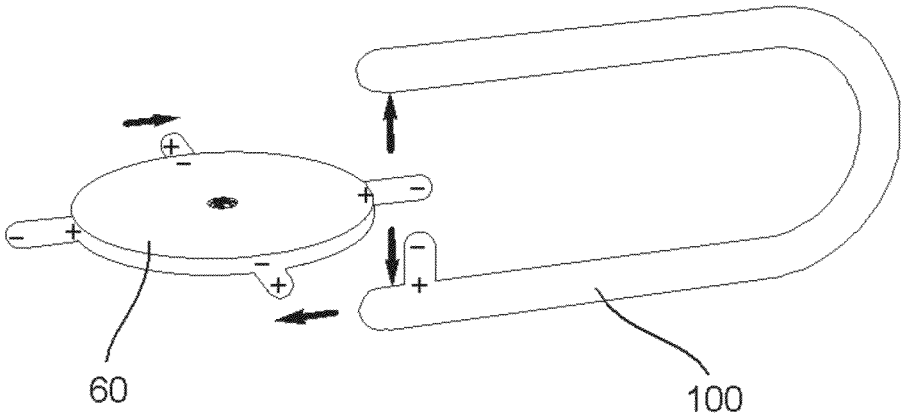

FIGS. 8*a* and 8*b* represent a resonator according to a third variant embodiment of the present invention.

In this variant, the tuning fork 100 and the escape wheel 60 are also contained in respective planes that are substantially orthogonal to one another, but this time, the tuning fork supports only one magnet arranged on one of the branches, as required.

The operating principle of the resonator according to this variant embodiment is similar to that which has been described above and will therefore not be repeated in detail.

FIG. 8*a* illustrates a position of the escape wheel 60 in which one of its magnets interacts with the magnet of the tuning fork in order to give rise to a mutual attraction.

FIG. 8*b* illustrates a position of the escape wheel 60 in which another of its magnets interacts with the magnet of the tuning fork in order to give rise to a mutual repulsion.

As has already been emphasized, the structure of the tuning fork is such that the magnetic interaction of a single of its branches with the escape wheel is sufficient to sustain its vibrations satisfactorily.

In general, the tuning fork may for example be made of silicon with addition of $SiO_2$ (notably in order to allow machining in batches), of quartz or of any other material having properties suitable for the application of the present invention, such as a combination of silicon and quartz making it possible to ensure a stable behavior as a function of the temperature.

Note also that, "permanent magnet" should be understood in this instance, without departing from the context of the invention, to be an element producing a permanent magnetic field, irrespective of its shape, that is to say that it can consist of a portion of material held in a solid block and having sustained a treatment for the purpose of having the required magnetic properties, of a fitted part, or even of a deposited layer, of a suitable magnetic material. It is possible notably to use any known iron oxide, or else to make deposits of layers of samarium and cobalt alloy for example.

It will be noted that the construction of the resonator according to the present invention allows it to be simply integrated into an existing clockwork caliber, by replacing the conventional resonator with a sprung balance, without requiring major modification of the clockwork caliber.

The foregoing description is intended to describe a particular embodiment as a nonlimiting illustration and, the invention is not limited to the implementation of certain particular features that have just been described, such as for example the shape specifically illustrated and described for the tuning fork, the escape wheel or the permanent magnets.

The one skilled in the art will have no particular difficulty in adapting the content of the present disclosure to his particular needs and in implementing a mechanical resonator different from that according to the embodiment described here, but comprising a free magnetic escapement as described above, without departing from the scope of the present invention.

It will be noted that, if the tuning fork comprises two magnets that are aligned and have the same magnetic orientation, the escape wheel comprises 2(2n+1) permanent magnets in order to allow the tuning fork to vibrate in its main vibration mode, while it comprises 4n permanent magnets if the respective orientations of the two magnets of the tuning fork are opposite.

In general, it will be noted that the invention is not limited to the number of magnets supported by the tuning fork, or to their respective positions on the branches of the tuning fork. Specifically, it is possible to provide only one of them, one per branch, or even more than one per branch, at any level of the branch in its longitudinal direction so long as the corresponding amplitude of the vibrations is sufficient, without departing from the scope of the invention.

What is claimed is:

1. A magnetic resonator, for a timepiece, comprising:

an oscillator of the tuning-fork type having first and second branches arranged substantially in the form of a U, at least a first of said branches supporting at least one first permanent magnet defining a first magnetic field; and an escape wheel, designed to be arranged in engagement with a first mobile of a watchwork gear train in order to allow said escape wheel to be driven by a power source of the timepiece, said escape wheel being situated within range of said first permanent magnet in order to undergo the influence of said first magnetic field, wherein said escape wheel is free and supports at least two permanent magnets, preferably at least four, arranged so that the vibrations of said first branch of said tuning fork, on the one hand, control the rotation speed of said escape wheel and, on the other hand, are sustained periodically by the magnetic interaction between said first permanent magnet of said tuning fork and said permanent magnets of said escape wheel in order to define a free escapement.

2. The resonator of claim 1, wherein said escape wheel supports 2n permanent magnets, n being at least equal to 1, preferably less than or equal to forty.

3. The resonator of claim 2, wherein said permanent magnets are evenly distributed close to the periphery of said escape wheel.

4. The resonator of claim 2, wherein two adjacent permanent magnets of said escape wheel are arranged relative to one another in order to present to said first permanent magnet of said tuning fork, when said escape wheel turns, respective inverted polarities when said two adjacent permanent magnets are successively situated facing said first permanent magnet.

5. The resonator of claim 2, wherein said escape wheel is arranged between said branches of said tuning fork.

6. The resonator of claim 5, wherein the second of said branches supports a second permanent magnet defining a second magnetic field and, wherein said permanent magnets of said escape wheel are arranged on said escape wheel such that they are diametrically opposed in twos by presenting magnetic orientations such that they have interactions of the same nature with said permanent magnets of said tuning fork.

7. The resonator of claim 6, wherein said permanent magnets of said tuning fork are substantially diametrically opposed to one another, with reference to said escape wheel.

8. The resonator of claim 1, wherein said permanent magnets of said tuning fork are placed close to the end of said corresponding branch.

9. A clockwork movement for a mechanical timepiece comprising a resonator as claimed in claim 2.

10. A mechanical timepiece comprising a clockwork movement as claimed in claim 9.

11. The resonator of claim 3, wherein two adjacent permanent magnets of said escape wheel are arranged relative to one another in order to present to said first permanent magnet of said tuning fork, when said escape wheel turns, respective inverted polarities when said two adjacent permanent magnets are successively situated facing said first permanent magnet.

12. The resonator of claim 3, wherein said escape wheel is arranged between said branches of said tuning fork.

13. The resonator of claim 4, wherein said escape wheel is arranged between said branches of said tuning fork.

14. The resonator of claim 12, wherein the second of said branches supports a second permanent magnet defining a second magnetic field and, wherein said permanent magnets of said escape wheel are arranged on said escape wheel such that they are diametrically opposed in twos by presenting magnetic orientations such that they have interactions of the same nature with said permanent magnets of said tuning fork.

15. The resonator of claim 13, wherein the second of said branches supports a second permanent magnet defining a second magnetic field and, wherein said permanent magnets of said escape wheel are arranged on said escape wheel such that they are diametrically opposed in twos by presenting magnetic orientations such that they have interactions of the same nature with said permanent magnets of said tuning fork.

16. The resonator of claim 14, wherein said permanent magnets of said tuning fork are substantially diametrically opposed to one another, with reference to said escape wheel.

17. The resonator of claim 15, wherein said permanent magnets of said tuning fork are substantially diametrically opposed to one another, with reference to said escape wheel.

18. The resonator of claim 6, wherein said permanent magnets of said tuning fork are placed close to the end of said corresponding branch.

19. A clockwork movement for a mechanical timepiece comprising a resonator as claimed in claim 6.

20. A mechanical timepiece comprising a clockwork movement as claimed in claim 19.

* * * * *